US012628972B2

(12) United States Patent
Carathers

(10) Patent No.: US 12,628,972 B2
(45) Date of Patent: May 19, 2026

(54) CUP WITH NAPKIN HOLDER

(71) Applicant: Kathenas Products, LLC, Lubbock, TX (US)

(72) Inventor: Charles Carathers, Knoxville, TN (US)

(73) Assignee: Kathenas Products, LLC, Lubbock, TX (US)

( * ) Notice: Subject to any disclaimer, the term of this patent is extended or adjusted under 35 U.S.C. 154(b) by 0 days.

(21) Appl. No.: 18/740,629

(22) Filed: Jun. 12, 2024

(65) Prior Publication Data

US 2024/0415304 A1 Dec. 19, 2024

Related U.S. Application Data

(60) Provisional application No. 63/508,024, filed on Jun. 14, 2023.

(51) Int. Cl.
*A47G 19/22* (2006.01)

(52) U.S. Cl.
CPC ..... *A47G 19/2227* (2013.01)

(58) Field of Classification Search
CPC ..... B65D 81/3865; B65D 81/3876; B65D 81/3879; B65D 81/3881; B65D 81/3886; B65D 81/3888; B65D 81/3897; A47G 19/22; A47G 19/2205
See application file for complete search history.

(56) References Cited

U.S. PATENT DOCUMENTS

| | | | | |
|---|---|---|---|---|
| 2012/0091156 | A1* | 4/2012 | Lee | B65D 81/3865 220/737 |
| 2017/0071384 | A1* | 3/2017 | de Guzman | B65D 81/3881 |
| 2017/0245667 | A1* | 8/2017 | Gaines | A47K 7/03 |
| 2022/0227537 | A1* | 7/2022 | Geschel | A45F 3/16 |
| 2022/0289463 | A1* | 9/2022 | Domingos | B65D 81/3876 |

* cited by examiner

*Primary Examiner* — Javier A Pagan
(74) *Attorney, Agent, or Firm* — Robinson IP Law, PLLC

(57) ABSTRACT

Various implementations include a cup. The cup incudes a bottom, at least one wall, and a shroud. The bottom has a first bottom surface and a second bottom surface. The at least one wall has a first wall end and a second wall end. The second wall end is coupled to the bottom, and the first wall end extends away from the first bottom surface. The at least one wall further has an outer wall surface and an inner wall surface. The shroud has a first shroud end coupled to the outer wall surface, a second shroud end, an outer shroud surface, and an inner shroud surface. The second shroud end extends toward a plane defined by the second bottom surface. A coupling space is defined between the outer wall surface and the inner shroud surface.

18 Claims, 3 Drawing Sheets

CUP WITH NAPKIN HOLDER

BACKGROUND

In humid environments, cups containing cold liquids often "sweat" along their side walls where the temperature of the air adjacent the wall decreases to the dew point of the air. This condensation can be a nuisance, especially when left on a wooden surface where it can soak into the wood and create rings.

Traditionally, coasters or paper napkins are used to set a cup on so that the condensation from the cup does not drip onto the surface below. However, the condensation can still drip from the cup when the cup is lifted from the coaster.

SUMMARY

Various implementations include a cup. The cup incudes a bottom, at least one wall, and a shroud. The bottom has a first bottom surface and a second bottom surface opposite and spaced apart from the first bottom surface. The at least one wall has a first wall end and a second wall end opposite and spaced apart from the first wall end. The second wall end is coupled to the bottom, and the first wall end extends away from the first bottom surface. The at least one wall further has an outer wall surface extending between the first wall end and the second wall end and an inner wall surface opposite and spaced apart from the outer wall surface. The shroud has a first shroud end coupled to the outer wall surface, a second shroud end opposite and spaced apart from the first shroud end, an outer shroud surface extending between the first shroud end and the second shroud end, and an inner shroud surface opposite and spaced apart from the outer shroud surface. The second shroud end extends toward a plane defined by the second bottom surface. A coupling space is defined between the outer wall surface and the inner shroud surface.

In some implementations, the shroud is a living hinge that is biased toward a first position and urgeable toward a second position. In some implementations, the second shroud end is closer to the outer wall surface in the first position than it is in the second position.

In some implementations, the shroud extends at least partially around the at least one wall in a direction parallel to a parametrical edge of the bottom. In some implementations, the shroud extends fully around the at least one wall in the direction parallel to the parametrical edge of the bottom.

In some implementations, a length of the shroud as measured from the first shroud end to the second shroud end is at least half the length of the at least one wall as measured from the first wall end to the second wall end. In some implementations, the second shroud end extends to a plane defined by the first bottom surface. In some implementations, the second shroud end extends to the plane defined by the second bottom surface.

In some implementations, the cup includes a polymer. In some implementations, the shroud includes a transparent material. In some implementations, the shroud includes a translucent material. In some implementations, the shroud and the wall are integrally formed.

In some implementations, the outer shroud surface defines at least one window opening extending to the inner shroud surface.

Various other implementations include a cup system. The system includes a cup as described herein and a napkin. The napkin has a first napkin surface, a second napkin surface opposite and spaced apart from the first napkin surface, and at least one napkin edge extending between the first napkin surface and the second napkin surface. At least one of the at least one napkin edge is disposed within the coupling space to couple the napkin to the cup.

In some implementations, the shroud is a living hinge that is biased toward a first position and urgeable toward a second position. In some implementations, the second shroud end is closer to the outer wall surface in the first position than it is in the second position.

In some implementations, the shroud extends at least partially around the at least one wall in a direction parallel to a parametrical edge of the bottom. In some implementations, the shroud extends fully around the at least one wall in the direction parallel to the parametrical edge of the bottom.

In some implementations, a length of the shroud as measured from the first shroud end to the second shroud end is at least half the length of the at least one wall as measured from the first wall end to the second wall end. In some implementations, the second shroud end extends to a plane defined by the first bottom surface. In some implementations, the second shroud end extends to the plane defined by the second bottom surface.

In some implementations, the cup includes a polymer. In some implementations, the shroud includes a transparent material. In some implementations, the shroud includes a translucent material. In some implementations, the shroud and the wall are integrally formed.

In some implementations, the outer shroud surface defines at least one window opening extending to the inner shroud surface.

In some implementations, the at least one of the at least one napkin edge is a first napkin edge. In some implementations, the napkin further includes a second napkin edge. In some implementations, the napkin extends around at least a portion of the second bottom surface, and the second napkin edge is disposed within the coupling space to further couple the napkin to the cup.

BRIEF DESCRIPTION OF DRAWINGS

Example features and implementations of the present disclosure are disclosed in the accompanying drawings. However, the present disclosure is not limited to the precise arrangements and instrumentalities shown. Similar elements in different implementations are designated using the same reference numerals.

DETAILED DESCRIPTION

The devices, systems, and methods disclosed herein provide for a cup with a built-in napkin holder. The cup includes a shroud that can be coupled to or integrally formed with the side wall of the cup. The shroud is coupled to an upper portion of the cup and extends down toward the base of the cup. The shroud can be made of a flexible or a rigid material. One or more portions of a napkin can be disposed between the outer surface of the side wall of the cup and the inner surface of the shroud to couple the portion or portions of the napkin to the cup.

In configurations in which the napkin extends under the cup, the napkin acts as a semi-permanent coaster for the cup. However, since the napkin is coupled to the cup by the friction of the shroud and the cup side wall, the napkin can be removed from the cup by applying force to the napkin. The napkin can then be used separately from the cup.

The cup can also allow the napkin to be visible, either directly or through the shroud material. This allows logos, text, or other information to be shown for informational or aesthetic purposes.

Various implementations include a cup. The cup incudes a bottom, at least one wall, and a shroud. The bottom has a first bottom surface and a second bottom surface opposite and spaced apart from the first bottom surface. The at least one wall has a first wall end and a second wall end opposite and spaced apart from the first wall end. The second wall end is coupled to the bottom, and the first wall end extends away from the first bottom surface. The at least one wall further has an outer wall surface extending between the first wall end and the second wall end and an inner wall surface opposite and spaced apart from the outer wall surface. The shroud has a first shroud end coupled to the outer wall surface, a second shroud end opposite and spaced apart from the first shroud end, an outer shroud surface extending between the first shroud end and the second shroud end, and an inner shroud surface opposite and spaced apart from the outer shroud surface. The second shroud end extends toward a plane defined by the second bottom surface. A coupling space is defined between the outer wall surface and the inner shroud surface.

Various other implementations include a cup system. The system includes a cup as described herein and a napkin. The napkin has a first napkin surface, a second napkin surface opposite and spaced apart from the first napkin surface, and at least one napkin edge extending between the first napkin surface and the second napkin surface. At least one of the at least one napkin edge is disposed within the coupling space to couple the napkin to the cup.

Figure 2:
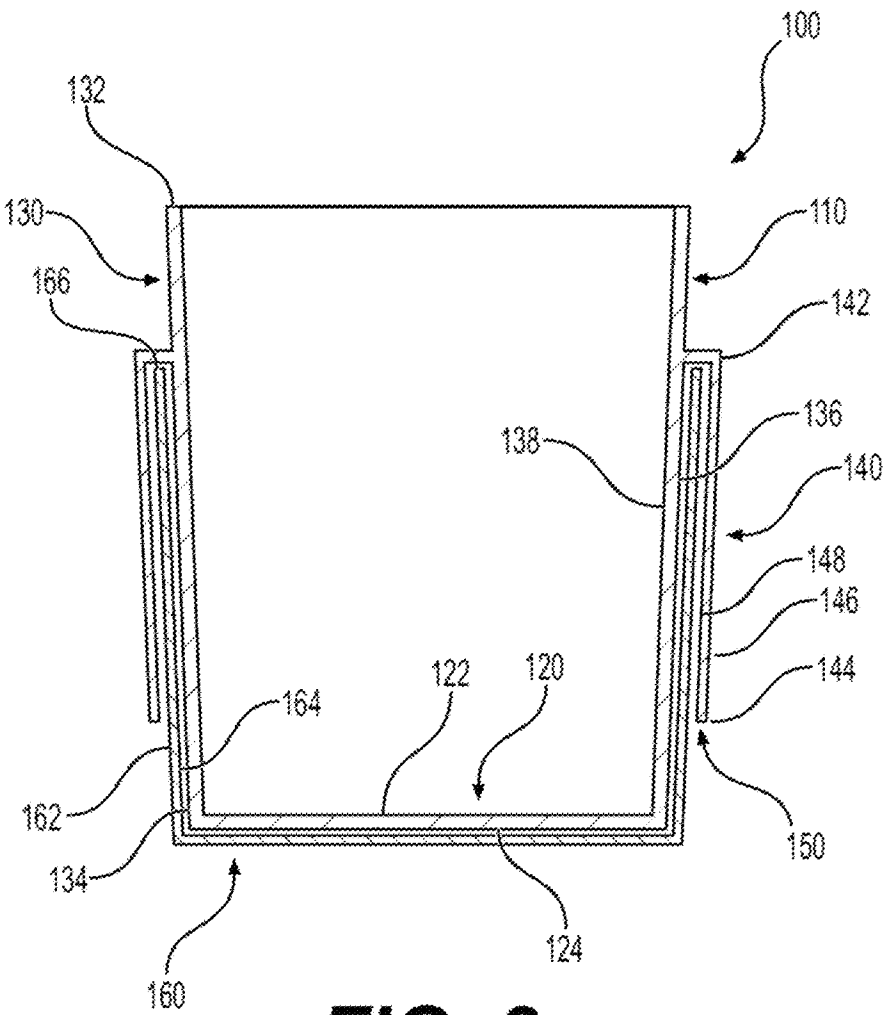
FIG. 2 is a cross-sectional view of the cup system along section line 2-2.
Figure 1:
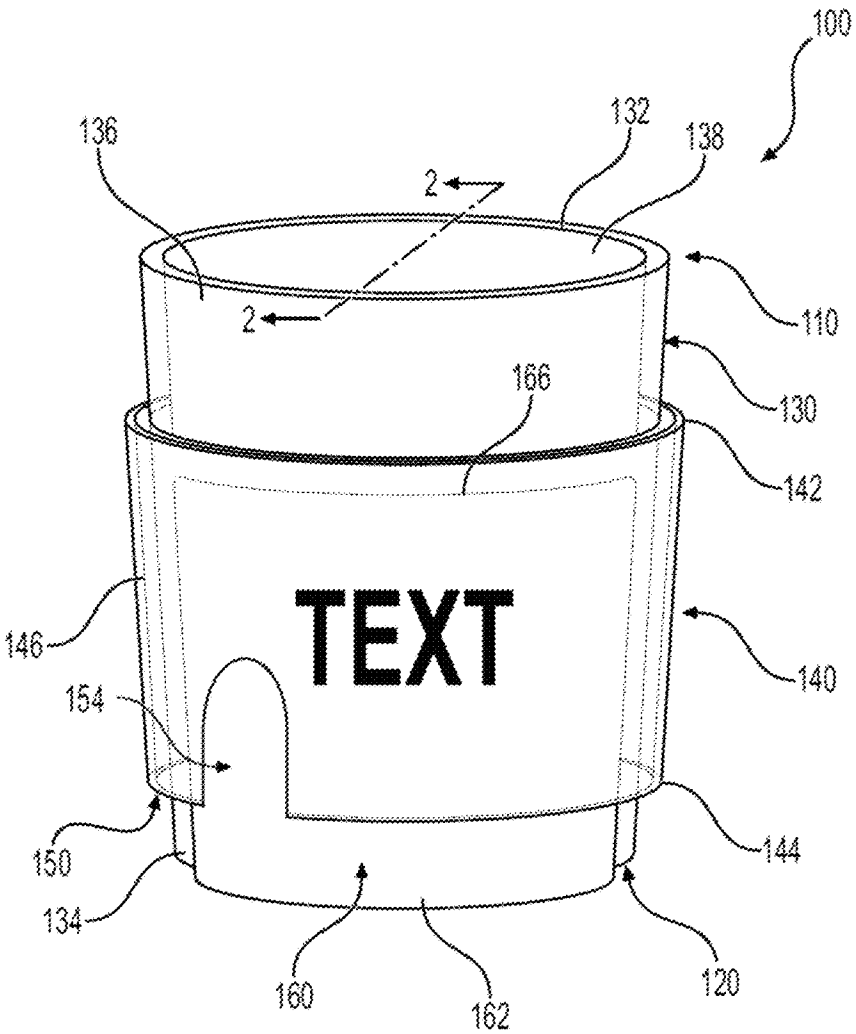
FIG. 1 is a perspective view of a cup system, according to one implementation.

FIGS. 1 and 2 show a cup system 100 configured to hold a napkin 160. The system includes a cup 110 and a napkin 160. The cup 110 includes a bottom 120, a wall 130, and a shroud 140.

The bottom 120 has a first bottom surface 122 and a second bottom surface 124 opposite and spaced apart from the first bottom surface 122. The bottom 120 shown in FIGS. 1 and 2 has a round shape as viewed in a plane defined by the first bottom surface 122 and in a plane defined by the second bottom surface 124. However, in some implementations, the bottom can have any regular or irregular closed shape such as an oval, a triangle, a rectangle, a square, a pentagram, a hexagram, or any other shape, as viewed in a plane defined by the first bottom surface, a plane defined by the second bottom surface, or both. In some implementations, the shape of the bottom as viewed in a plane defined by the first bottom surface and in a plane defined by the second bottom surface are different.

The wall 130 shown in FIGS. 1 and 2 is a hollow, frustoconical shape. The wall 130 has a first wall end 132 at the largest diameter portion and a second wall end 134 opposite and spaced apart from the first wall end 132. The wall 130 further has an outer wall surface 136 extending between the first wall end 132 and the second wall end 134 and an inner wall surface 138 opposite and spaced apart from the outer wall surface 136. Although the wall 130 shown in FIGS. 1 and 2 is frustoconical, in some implementations, the wall is any regular or irregular, hollow closed shape such as an oval, a triangle, a rectangle, a square, a pentagram, a hexagram, or any other shape in a plane parallel to the first bottom surface, the second bottom surface, or both. In some implementations, the wall of the cup does not include a taper such that the diameter or width of the first wall end is equal to the diameter or width of the second wall end.

The second wall end 134 is coupled to the bottom 120 and the first wall end 132 extends away from the first bottom surface 122 to create a cup 110 that is open only at the first wall end 132.

The shroud 140 has a first shroud end 142 coupled to the outer wall surface 136 and a second shroud end 144 opposite and spaced apart from the first shroud end 142. The shroud 140 further has an outer shroud surface 146 extending between the first shroud end 142 and the second shroud end 144 and an inner shroud surface 148 opposite and spaced apart from the outer shroud surface 146. The second shroud end 144 extends toward a plane defined by the second bottom surface 124, the first bottom surface 122, or both. The shroud 140 extends fully around the wall 130 in a direction parallel to the parametrical edge of the bottom 120 to form a continuous annular shape around the wall 130. However, in some implementations, the shroud extends only partially around the wall in the direction parallel to the parametrical edge of the bottom such that the shroud forms a partial clip, as discussed below. In some implementations, the cup includes a first shroud and a second shroud that each extends only partially around the wall and are spaced apart from each other in the direction parallel to the parametrical edge of the bottom. In these implementations, the first shroud and the second shroud form two separate clips. In some implementations, the cup includes three or more shrouds.

The length of the shroud 140 as measured from the first shroud end 142 to the second shroud end 144 is at least half the length of the wall 130 as measured from the first wall end 132 to the second wall end 134. However, in some implementations, the length of the shroud can be shorter or longer depending on the use of the shroud. For example, in some implementations, the second shroud end extends to a plane defined by the first bottom surface. In some implementations, the second shroud end extends to the plane defined by the second bottom surface.

The shroud 140 is slightly spaced apart from the outer wall surface 136 such that a coupling space 150 is defined between the outer wall surface 136 and the inner shroud surface 148. In some implementations, the coupling of the first shroud end to the outer wall surface can form a living hinge. The living hinge is biased toward a first position and urgeable toward a second position. The second shroud end is closer to the outer wall surface in the first position than it is in the second position.

The shroud 140 further defines a finger opening 154. The finger opening is a portion of the shroud 140 that allows a user or manufacturer to insert their finger through the shroud 140 for easier placement of a napkin 160 or other item to be inserted into the coupling space 150. The finger opening 154 extends from the outer shroud surface 146 to the inner shroud surface 148. The finger opening 154 shown in FIG. 1 extends from the second shroud end 144 toward the first shroud end 142. However, in some implementations, the finger opening is fully disposed between the first shroud end and the second shroud end. In some implementations, the finger opening extends from the second shroud end to the first shroud end. In some implementations, the shroud includes two or more finger openings. In some implementations, the shroud does not include a finger opening. The finger opening can be any width to accommodate different sized fingers. In some implementations, the finger opening can be sized to accommodate a tool and not a finger. In such implementations, the opening can be a narrower width opening than would accommodate the typical finger.

The cup 110 shown in FIGS. 1 and 2 is made of a polymer, but in some implementations, the cup can be made of any other material. The shroud 140 and the wall 130 are integrally formed, but in some implementations, the shroud and the wall can be separately formed and coupled together by any known means. In some implementations, the shroud is not fixedly coupled to the wall of the cup but is coupled to the tapering side of the cup by a friction fit.

Figure 3:
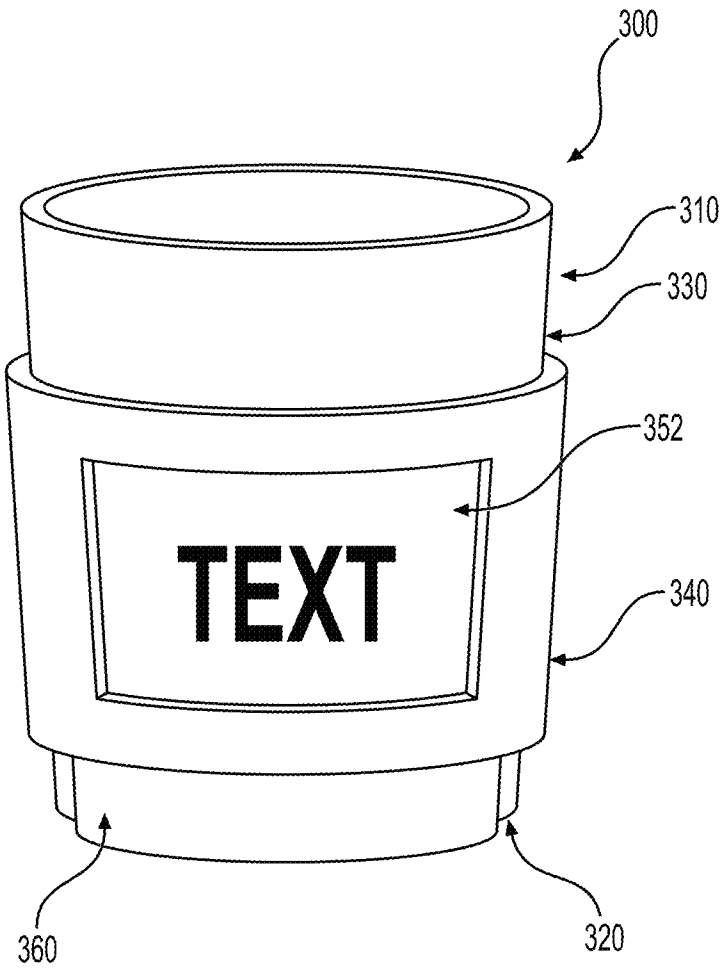
FIG. 3 is a perspective view of a cup system, according to another implementation.

The polymer from which the shroud 140, the wall 130, and the bottom 120 are formed in FIGS. 1 and 2 is a transparent material. Thus, any logo, text, or design displayed on the napkin 160 can be seen through the shroud 140. However, in some implementations, like the cups 310, 410, 510, 610 shown in FIGS. 3-6, the polymer from which the shroud 340, 440, 540, 640, the wall 330, 430, 530, 630, and the bottom 320, 420, 520, 620 are formed is a translucent or opaque material. In some implementations, like the cup 310 of the system 300 shown in FIG. 3, the shroud 340 includes a window portion 352 that is either an opening defined by the outer shroud surface and extending to the inner shroud surface or is made of a material that can be seen through.

The napkin 160 has a first napkin surface 162 and a second napkin surface 164 opposite and spaced apart from the first napkin surface 162. The first napkin surface 162 includes text (e.g., for advertisement or informational). The first napkin surface 162 and the second napkin surface 164 shown in FIGS. 1-5 are square-shaped and include four napkin edges 166 extending between the first napkin surface 162 and the second napkin surface 164.

As shown in FIGS. 1 and 2, a first napkin edge 166 is disposed within the coupling space 150 to couple the napkin 160 to the cup 110. The napkin 160 extends around at least a portion of the second bottom surface 124, and a second napkin edge 166 is disposed within the coupling space 150 on the diametrically opposed side of the cup 110 to further couple the napkin 160 to the cup 110.

Figure 4:
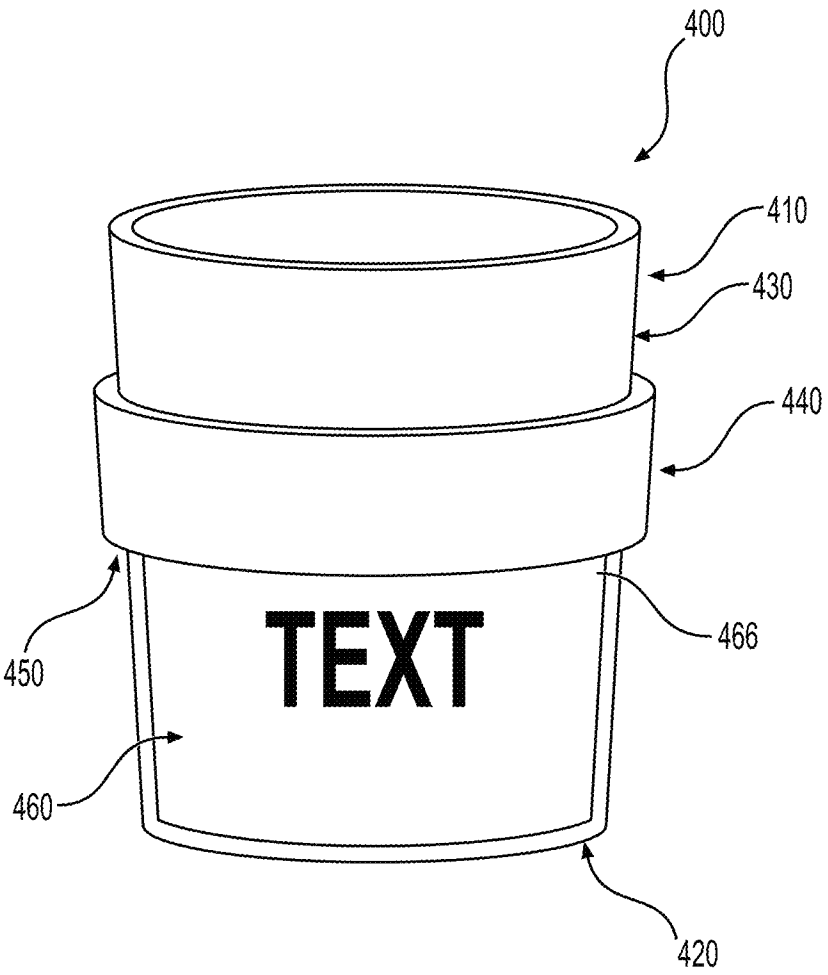
FIG. 4 is a perspective view of a cup system, according to another implementation.
Figure 5:
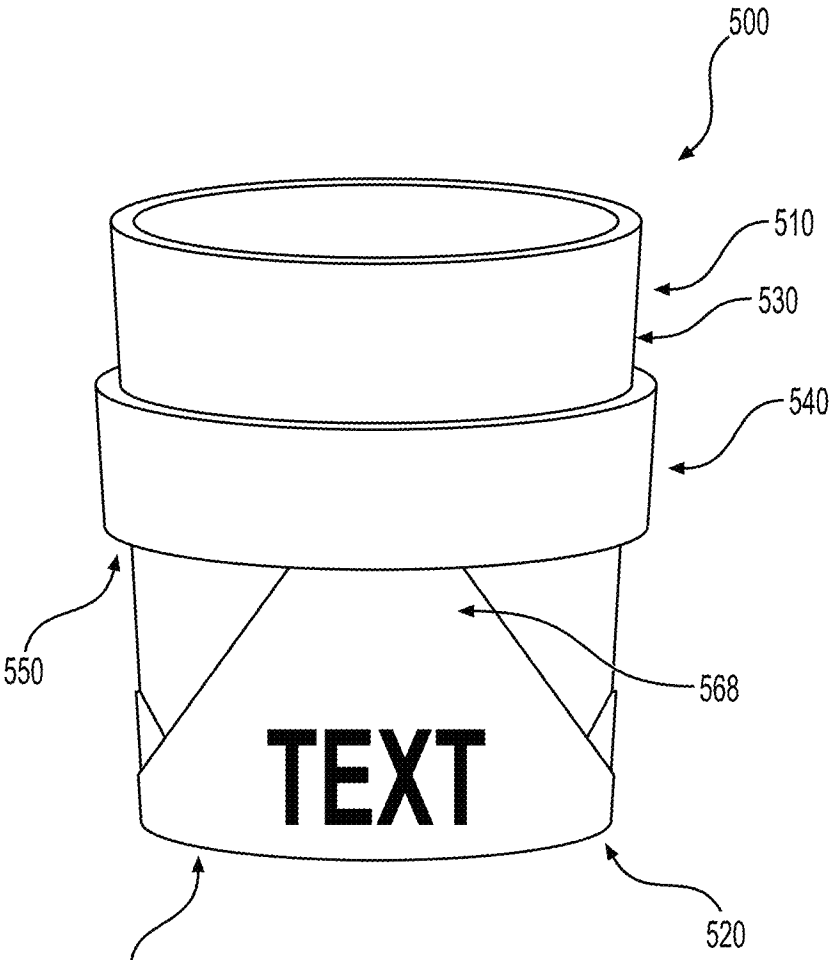
FIG. 5 is a perspective view of a cup system, according to another implementation.

FIG. 4 shows another implementation of a system 400 in which a napkin 460 is coupled to a cup 410. In this implementation, only a first napkin edge 466 is disposed within the coupling space 450 to couple the napkin 460 to the cup 410. FIG. 5 shows another implementation of a system 500 in which a napkin 560 is coupled to a cup 510, in which the four corners 568 of the napkin 560 are disposed within the coupling space 550 to couple the napkin 560 to the cup 510.

Figure 6:
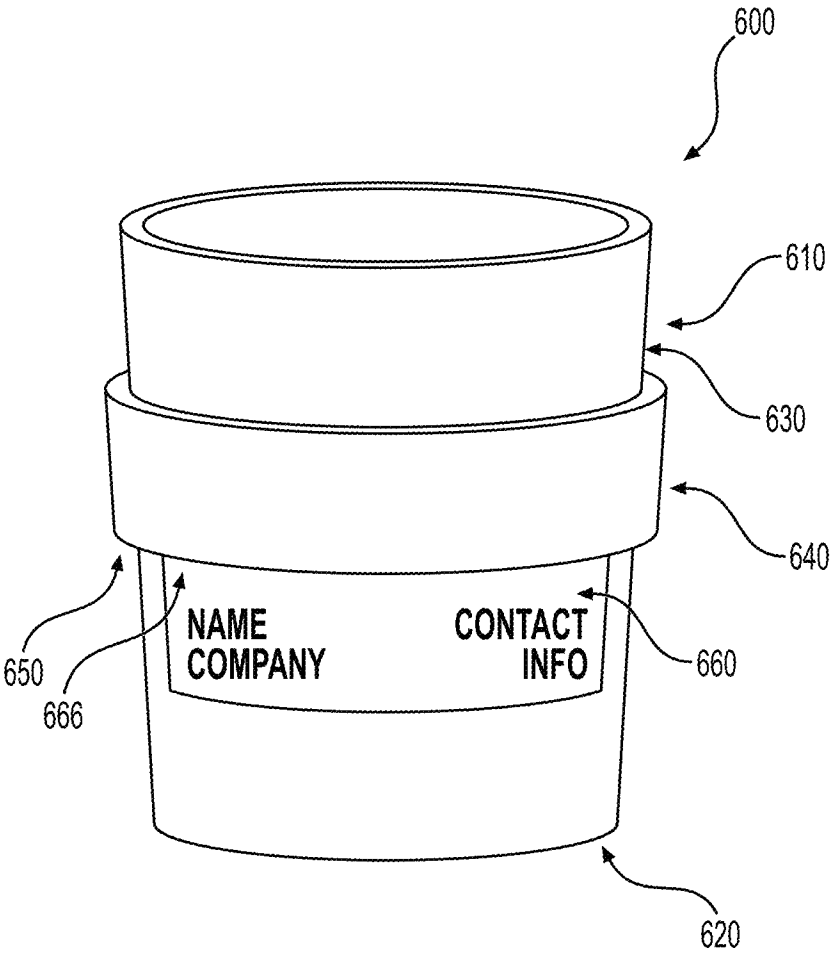
FIG. 6 is a perspective view of a cup system, according to another implementation.

Although the systems 100, 300, 400, 500 shown in FIGS. 1-5 include a napkin 160, 360, 460, 560, in some implementations, like the system 600 shown in FIG. 6, the system includes a business card 660 coupled to a cup 610. A first edge 666 of the business card 660 is disposed within the coupling space 650 to couple the business card 660 to the cup 610. In some implementations, the system includes a pamphlet, a piece of paper, a sleeve, or any other flexible material object disposed at least partially within the coupling space to couple the object to the cup.

In some implementations, the wall of the cup has a thickness as measured from the inner wall surface to the outer wall surface. In some implementations, the thickness varies from the first wall end to the second wall end. In some implementations, the thickness changes at the portion of the wall where the first shroud end is coupled to the outer wall surface such that the thickness of the wall adjacent the second wall end is less than the thickness adjacent the first wall end. Because the thickness decreases where the first shroud end is coupled to the outer wall surface, the outer shroud surface is flush with the portion of the outer wall surface adjacent the first wall end such that the portion of the outer wall surface adjacent the first wall end seamlessly blends with the outer shroud surface. Because the thickness of the wall decreases where the first shroud end couples to the outer wall surface, the portion of the outer wall surface adjacent the second wall end is spaced apart from the inner shroud surface, creating a coupling space defined between the outer wall surface and the inner shroud surface.

A number of example implementations are provided herein. However, it is understood that various modifications can be made without departing from the spirit and scope of the disclosure herein. As used in the specification, and in the appended claims, the singular forms "a," "an," "the" include plural referents unless the context clearly dictates otherwise. The term "comprising" and variations thereof as used herein is used synonymously with the term "including" and variations thereof and are open, non-limiting terms. Although the terms "comprising" and "including" have been used herein to describe various implementations, the terms "consisting essentially of" and "consisting of" can be used in place of "comprising" and "including" to provide for more specific implementations and are also disclosed.

Disclosed are materials, systems, devices, methods, compositions, and components that can be used for, can be used in conjunction with, can be used in preparation for, or are products of the disclosed methods, systems, and devices. These and other components are disclosed herein, and it is understood that when combinations, subsets, interactions, groups, etc. of these components are disclosed that while specific reference of each various individual and collective combinations and permutations of these components may not be explicitly disclosed, each is specifically contemplated and described herein. For example, if a device is disclosed and discussed each and every combination and permutation of the device are disclosed herein, and the modifications that are possible are specifically contemplated unless specifically indicated to the contrary. Likewise, any subset or combination of these is also specifically contemplated and disclosed. This concept applies to all aspects of this disclosure including, but not limited to, steps in methods using the disclosed systems or devices. Thus, if there are a variety of additional steps that can be performed, it is understood that each of these additional steps can be performed with any specific method steps or combination of method steps of the disclosed methods, and that each such combination or subset of combinations is specifically contemplated and should be considered disclosed.

What is claimed is:

1. A cup comprising:

a bottom having a first bottom surface and a second bottom surface opposite and spaced apart from the first bottom surface;

at least one wall having a first wall end and a second wall end opposite and spaced apart from the first wall end, wherein the second wall end is coupled to the bottom and the first wall end extends away from the first bottom surface, wherein the at least one wall further has an outer wall surface extending between the first wall end and the second wall end and an inner wall surface opposite and spaced apart from the outer wall surface; and a shroud having a first shroud end coupled to the outer wall surface, a second shroud end opposite and spaced apart from the first shroud end, an outer shroud surface extending between the first shroud end and the second shroud end, and an inner shroud surface opposite and spaced apart from the outer shroud surface, wherein the second shroud end extends toward a plane defined by the second bottom surface, wherein a coupling space is defined between the outer wall surface and the inner shroud surface, and wherein the shroud is a living hinge that is biased toward a first position and urgeable toward a second position, wherein the second shroud end is closer to the outer wall surface in the first position than it is in the second position.

2. The cup of claim 1, wherein the shroud extends at least partially around the at least one wall in a direction parallel to a parametrical edge of the bottom.

3. The cup of claim 2, wherein the shroud extends fully around the at least one wall in the direction parallel to the parametrical edge of the bottom.

4. The cup of claim 1, wherein a length of the shroud as measured from the first shroud end to the second shroud end is at least half the length of the at least one wall as measured from the first wall end to the second wall end.

5. The cup of claim 1, wherein the second shroud end extends to a plane defined by the first bottom surface.

6. The cup of claim 5, wherein the second shroud end extends to the plane defined by the second bottom surface.

7. The cup of claim 1, wherein the cup comprises a polymer.

8. The cup of claim 1, wherein the shroud comprises a transparent or translucent material.

9. The cup of claim 1, wherein the shroud defines one or more finger openings extending from the second shroud end toward the first shroud end.

10. The cup of claim 1, wherein the shroud and the wall are integrally formed.

11. The cup of claim 1, wherein the outer shroud surface defines at least one window opening extending to the inner shroud surface.

12. A cup system, the system comprising:

a cup comprising:

a bottom having a first bottom surface and a second bottom surface opposite and spaced apart from the first bottom surface, at least one wall having a first wall end and a second wall end opposite and spaced apart from the first wall end, wherein the second wall end is coupled to the bottom and the first wall end extends away from the first bottom surface, wherein the at least one wall further has an outer wall surface extending between the first wall end and the second wall end and an inner wall surface opposite and spaced apart from the outer wall surface, and a shroud having a first shroud end coupled to the outer wall surface, a second shroud end opposite and spaced apart from the first shroud end, an outer shroud surface extending between the first shroud end and the second shroud end, and an inner shroud surface opposite and spaced apart from the outer shroud surface, wherein the second shroud end extends toward a plane defined by the second bottom surface, wherein a coupling space is defined between the outer wall surface and the inner shroud surface, and wherein the shroud is a living hinge that is biased toward a first position and urgeable toward a second position, wherein the second shroud end is closer to the outer wall surface in the first position than it is in the second position; and a napkin having a first napkin surface, a second napkin surface opposite and spaced apart from the first napkin surface, and at least one napkin edge extending between the first napkin surface and the second napkin surface, wherein at least one of the at least one napkin edge is disposed within the coupling space to couple the napkin to the cup.

13. The system of claim 12, wherein the shroud extends fully around the at least one wall in the direction parallel to the parametrical edge of the bottom.

14. The system of claim 12, wherein a length of the shroud as measured from the first shroud end to the second shroud end is at least half the length of the at least one wall as measured from the first wall end to the second wall end.

15. The system of claim 12, wherein the shroud comprises a transparent or translucent material.

16. The system of claim 12, wherein the shroud defines one or more finger openings extending from the second shroud end toward the first shroud end.

17. The system of claim 12, wherein the outer shroud surface defines at least one window opening extending to the inner shroud surface.

18. The system of claim 12, wherein the at least one of the at least one napkin edge is a first napkin edge, the napkin further comprising a second napkin edge, wherein the napkin extends around at least a portion of the second bottom surface and the second napkin edge is disposed within the coupling space to further couple the napkin to the cup.

* * * * *